US006575267B1

(12) United States Patent
Stiles et al.

(10) Patent No.: US 6,575,267 B1
(45) Date of Patent: Jun. 10, 2003

(54) EXHAUST COMPONENT HAVING MULTIPLE-PLATED OUTER SHELL

(75) Inventors: Philip Donald Stiles, Indianapolis, IN (US); Jerry Brian Hornback, Franklin, IN (US)

(73) Assignee: ArvinMeritor, Inc., Troy, MI (US)

( * ) Notice: Subject to any disclaimer, the term of this patent is extended or adjusted under 35 U.S.C. 154(b) by 0 days.

(21) Appl. No.: 09/743,179

(22) PCT Filed: Jul. 7, 1999

(86) PCT No.: PCT/US99/15292

§ 371 (c)(1),
(2), (4) Date: Feb. 23, 2001

(87) PCT Pub. No.: WO00/01931

PCT Pub. Date: Jan. 13, 2000

Related U.S. Application Data

(60) Provisional application No. 60/091,932, filed on Jul. 7, 1998.

(51) Int. Cl.[7] ..... F01N 7/18

(52) U.S. Cl. ..... 181/282; 181/243

(58) Field of Search ..... 181/243, 282; 29/890.08

(56) References Cited

U.S. PATENT DOCUMENTS

| | | | | | |
|---|---|---|---|---|---|
| 2,107,588 | A | * | 2/1938 | Smith | 181/243 |
| 5,340,952 | A | * | 8/1994 | Takiguchi | 181/282 |
| 5,422,445 | A | * | 6/1995 | Baird et al. | 181/282 |
| 5,581,056 | A | * | 12/1996 | Bellgardt et al. | 181/282 |

FOREIGN PATENT DOCUMENTS

| | | |
|---|---|---|
| JP | 02-85819 | 7/1990 |

* cited by examiner

*Primary Examiner*—Khanh Dang
(74) *Attorney, Agent, or Firm*—Barnes & Thornburg

(57) ABSTRACT

A housing for an exhaust component having a longitudinal axis, an outer shell, an inner shell positioned within the outer shell, an expanding joint for permitting relative longitudinal movement of the inner and outer shells in response to temperature differences between the inner and outer shells, and an expanding joint for permitting relative circumferential movement of the inner and outer shells in response to temperature differences between the inner and outer shells.

22 Claims, 5 Drawing Sheets

EXHAUST COMPONENT HAVING MULTIPLE-PLATED OUTER SHELL

This application claims the benefit of Provisional Application No. 60/091,932, filed Jul. 7, 1998.

BACKGROUND AND SUMMARY OF THE INVENTION

The present invention relates to mufflers, and particularly to mufflers having multiple-plated outer shells. More particularly, the present invention relates to multiple-plated outer shells having thermal expansion portions that permit the multiple plates of the outer shell to move relative to each other.

The flow of exhaust gas through a muffler having a multiple-plated outer shell causes the outer shell to heat up due to the high temperature of the exhaust gas. Multiple-plated outer shells include an inner plate that is in direct contact with the hot exhaust gas and an outer plate that is insulated from the exhaust gas by the inner plate. This arrangement of the inner and outer plates causes the inner plate to heat up faster than the outer plate. As a result, the inner plate expands relative to the outer plate. In addition, this arrangement causes the outer plate to cool down faster than the inner plate which results in the outer plate contracting relative to the inner plate. The relative expansion and contraction of the inner and outer plates causes compressive and tensile forces in the inner and outer plates. These compressive and tensile forces are repeated every time the inner plate expands relative to the outer plate. The compressive forces in the inner plate may cause buckling of the inner plate.

An exhaust component is provided having first and second end caps, an inner shell coupled to the first and second end caps, and an outer shell coupled to the first and second end caps. A channel is defined between the inner shell and one of the first and second end caps. A portion of the outer shell is positioned in the channel to move longitudinally through the channel relative to the inner shell. The outer shell includes a notch member that is spaced apart from the inner shell. The notch member configured to change shape to permit the outer shell to move circumferentially relative to the inner shell.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the following figures in which:

FIG. 4 is an enlarged sectional view of the circumferential expansion portion shown in FIG. 3 taken along line 4—4 of FIG. 2 showing the inner and outer plates at approximately the same temperature so that the inner plate is in an unexpanded state relative to the outer plate and the circumferential expansion portion is in an ambient condition with the gap between the inner and outer plates being at a maximum distance;

FIG. 5 shows the circumferential expansion portion of FIG. 4 with a moderate amount of heat being applied to the inner plate so that the inner plate is in a slightly expanded state relative to the outer plate, the notch member is slightly flattened relative to the inner plate to accommodate the outwardly expanding inner plate, and the gap between the inner and outer plates being slightly smaller than in FIG. 4;

FIG. 6 shows the circumferential expansion portion of FIG. 5 with an intense amount of heat being applied to the inner plate so that the inner plate is in a significantly expanded state relative to the outer plate, the notch member is significantly flattened relative to the inner plate, and the gap between the inner and outer plates being slightly smaller than in FIG. 5;

FIG. 7 shows the circumferential expansion portion of FIG. 6 with intense heat being applied to the inner plate and cold drops of water hitting the outer plate so that the inner plate is in a maximally expanded state relative to the outer plate, the notch member being maximally flattened relative to the inner plate, and the gap between the inner and outer plates being at a minimum;

FIG. 8 is a sectional view taken along line 8—8 of FIG. 1 showing the leftmost portion of the longitudinally extending circumferential expansion portion and the bottom-most portion of the first circumferentially extending longitudinal expansion portion, the first longitudinal expansion portion being defined as the portion of the muffler where the left end cap is lockseamed with the left side of the outer shell to define a circumferentially extending channel between the inner plate and left end cap for receiving the outer plate, the first longitudinal expansion portion and the circumferential expansion portion both being in an ambient condition with the inner plate, left end cap, and outer plate being at approximately the same temperature so that the inner plate and left end cap are in an unexpanded state relative to the outer plate, the gap of the circumferential expansion portion being at a maximum, and the outer plate extending a maximum distance into the channel defined between the inner plate and end cap;

FIG. 9 is a sectional view similar to FIG. 8 showing a moderate amount of heat being applied to the inner plate and left end cap so that the inner plate and left end cap are in a slightly expanded state relative to the outer plate and, to accommodate the slightly outwardly expanding inner plate and left end cap, the circumferential expansion portion being slightly flattened relative to the inner plate and the outer plate being slid slightly longitudinally inwardly within the channel away from the left end cap;

FIG. 10 is a sectional view similar to FIG. 9 showing an intense amount of heat being applied to the inner plate and left end cap so that the inner plate and left end cap are in a significantly expanded state relative to the outer plate and, to accommodate the significantly outwardly expanding inner plate and left end cap, the circumferential expansion portion being significantly flattened relative to the inner plate and the outer plate being slid significantly longitudinally inwardly within the channel away from the left end cap;

FIG. 11 is a sectional view similar to FIG. 10 showing an intense amount of heat being applied to the inner plate and left end cap and cold drops of water hitting the outer plate so that the inner plate and left end cap are in a maximally expanded state relative to the outer plate and, to accommodate the maximally outwardly expanding inner plate and left end cap, the circumferential expansion portion being 15 maximally flattened relative to the inner plate and the outer plate being slid maximally longitudinally inwardly within the channel away from the left end cap;

FIG. 12 is a sectional view taken along line 12—12 of FIG. 1 showing another portion of the first longitudinal expansion portion, the inner plate, left end cap, and outer plate being at approximately the same temperature so that the inner plate and left end cap are in an unexpanded state relative to the outer plate, and the first longitudinal expansion portion being in an ambient condition with the outer plate extending the maximum distance into the channel;

FIG. 13 is a sectional view similar to FIG. 12 showing a moderate amount of heat being applied to the inner plate and left end cap so that the inner plate and left end cap are in a slightly expanded state relative to the outer plate and the outer plate being slid slightly longitudinally inwardly within the channel away from the left end cap;

FIG. 14 is a sectional view similar to FIG. 12 showing an intense amount of heat being applied to the inner plate and left end cap so that the inner plate and left end cap are in a significantly expanded state relative to the outer plate and the outer plate being slid significantly longitudinally inwardly within the channel away from the left end cap;

FIG. 15 is a sectional view similar to FIG. 12 showing an intense amount of heat being applied to the inner plate and left end cap and cold drops of water hitting the outer plate so that the inner plate and left end cap are in a maximally expanded state relative to the outer plate and the outer plate being slid maximally longitudinally inwardly within the channel away from the left end cap;

FIG. 16 is a sectional view taken along line 16—16 of FIG. 1 showing the right-most portion of the longitudinally extending circumferential expansion portion and the bottom-most portion of the second circumferentially extending longitudinal expansion portion, the second longitudinal expansion portion being defined as the portion of the muffler where the right end cap is lockseamed with the right side of the outer shell to define a circumferentially extending channel between the inner plate and right end cap for receiving the outer plate, the second longitudinal expansion portion and the circumferential expansion portion both being in an ambient condition with the inner plate, right end cap, and outer plate being at approximately the same temperature so that the inner plate and right end cap are in an unexpanded state relative to the outer plate, the gap of the circumferential expansion portion being at a maximum, and the outer plate extending a maximum distance into the channel;

FIG. 17 is a sectional view similar to FIG. 16 showing a moderate amount of heat being applied to the inner plate and right end cap so that the inner plate and right end cap are in a slightly expanded state relative to the outer plate and, to accommodate the slightly outwardly expanding inner plate and right end cap, the circumferential expansion portion being slightly flattened relative to the inner plate and the outer plate being slid slightly longitudinally inwardly within the channel away from the right end cap;

FIG. 18 is a sectional view similar to FIG. 17 showing an intense amount of heat being applied to the inner plate and right end cap so that the inner plate and right end cap are in a significantly expanded state relative to the outer plate and, to accommodate the significantly outwardly expanding inner plate and right end cap, the circumferential expansion portion being significantly flattened relative to the inner plate and the outer plate being slid significantly longitudinally inwardly within the channel away from the right end cap;

FIG. 19 is a sectional view similar to FIG. 18 showing an intense amount of heat being applied to the inner plate and right end cap and cold drops of water hitting the outer plate so that the inner plate and right end cap are in a maximally expanded state relative to the outer plate and, to accommodate the maximally outwardly expanding inner plate and right end cap, the circumferential expansion portion being maximally flattened relative to the inner plate and the outer plate being slid maximally longitudinally inwardly within the channel away from the right end cap;

FIG. 20 is a sectional view taken along line 20—20 of FIG. 1 showing another portion of the second longitudinal expansion portion, the inner plate, right end cap, and outer plate being at approximately the same temperature so that the inner plate and right end cap are in an unexpanded state relative to the outer plate, and the second longitudinal expansion portion being in an ambient condition with the outer plate extending the maximum distance into the channel;

FIG. 21 is a sectional view similar to FIG. 20 showing a moderate amount of heat being applied to the inner plate and right end cap so that the inner plate and right end cap are in a slightly expanded state relative to the outer plate and the outer plate being slid slightly longitudinally inwardly within the channel away from the right end cap;

FIG. 22 is a sectional view similar to FIG. 20 showing an intense amount of heat being applied to the inner plate and right end cap so that the inner plate and right end cap are in a significantly expanded state relative to the outer plate and the outer plate being slid significantly longitudinally inwardly within the channel away from the right end cap;

FIG. 23 is a sectional view similar to FIG. 20 showing an intense amount of heat being applied to the inner plate and right end cap and cold drops of water hitting the outer plate so that the inner plate and right end cap are in a maximally expanded state relative to the outer plate and the outer plate being slid maximally longitudinally inwardly within the channel away from the right end cap.

DETAILED DESCRIPTION OF THE DRAWINGS

Figure 1:
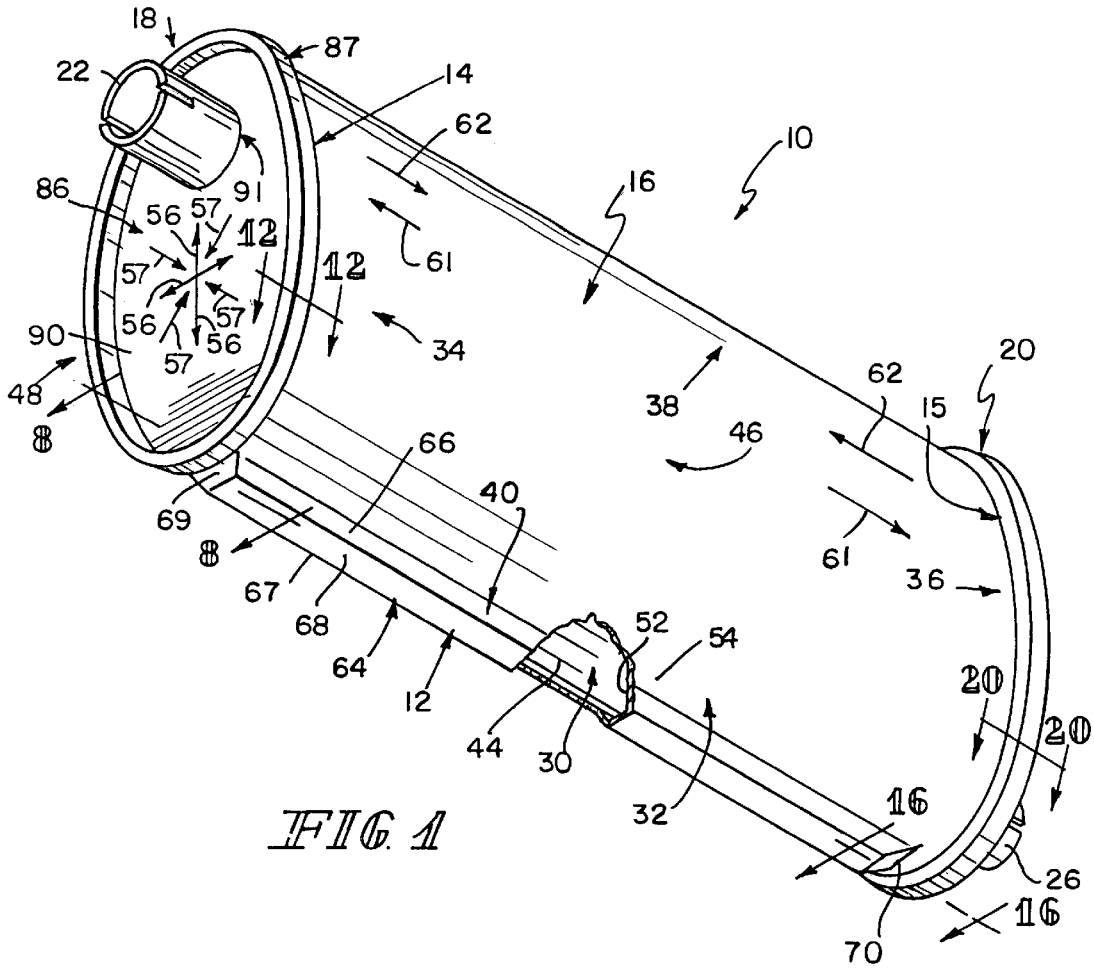
FIG. 1 is a perspective view of a muffler including a multiple-plated outer shell having an inner plate and an outer plate, a left end cap being coupled to a left side of the outer shell, a right end cap being coupled to a right side of the outer shell, an inlet tube being coupled to the left end cap, and an outlet tube being coupled to the right end cap.
Figure 2:
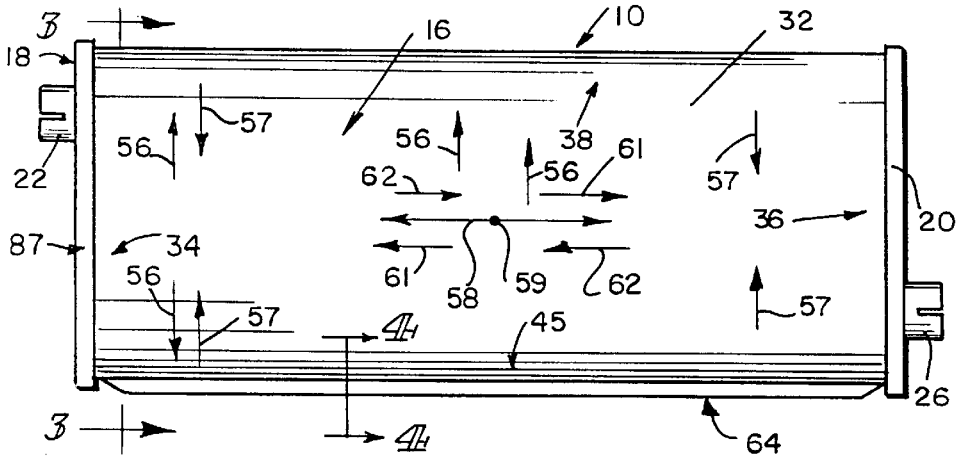
FIG. 2 is a side elevation view of the muffler of FIG. 1.
Figure 3:
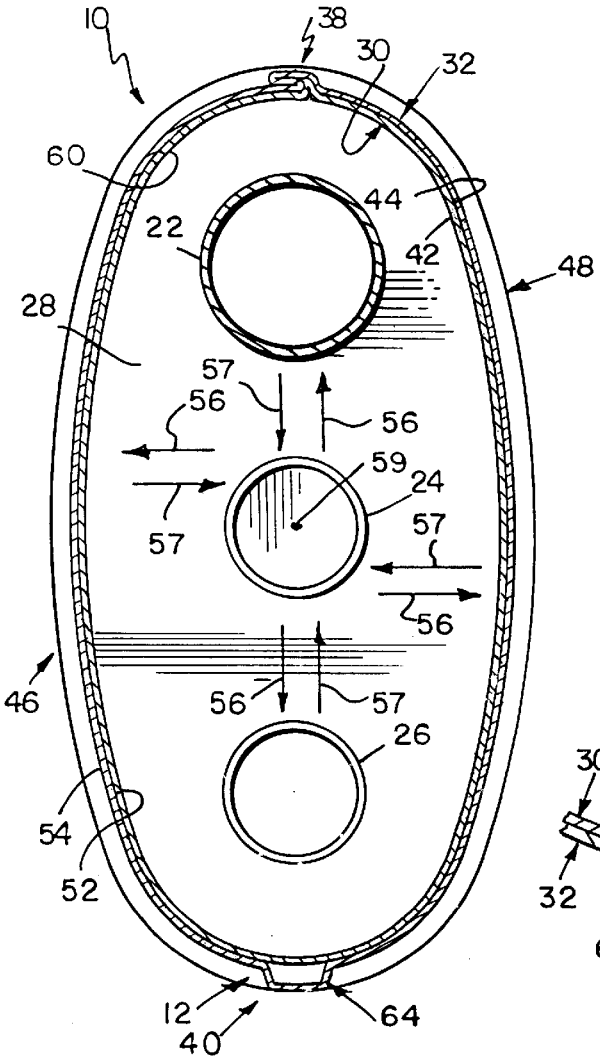
FIG. 3 is a sectional view taken along line 3—3 of FIG. 2 showing the inner and outer plates of the outer shell being lockseamed together along a top side of the outer shell and the outer plate being formed to include a notch member that extends along a bottom side of the outer shell and defines a longitudinally extending circumferential expansion portion, the notch member defining a gap between the inner and outer plates to allow the inner plate to expand or contract circumferentially outwardly or inwardly relative to the outer plate.

A muffler 10 is shown in FIGS. 1–3. Muffler 10 preferably includes a left end cap 18, a right end cap 20, a plurality of exhaust tubes 22, 24, 26, an oval-shaped baffle plate 28 (shown in FIG. 3), and a multiple-plated outer case 16 having an inner shell or plate 30 and an outer shell or plate 32. Muffler 10 also includes a longitudinally extending circumferential expansion portion 12 and two circumferentially extending longitudinal expansion portions 14, 15 that permit inner and outer plates 30, 32 of outer case 16 to move relative to each other. "Longitudinally" is defined herein as lengthwise between left and right sides 34, 36 of muffler 10 along or parallel to a longitudinal axis 58 that runs through a center 59 of muffler 10 in an outward direction 61 or an inward direction 62, as shown in FIG. 2. "Circumferentially" is defined herein as perpendicular to longitudinal axis 58 in an outward direction 56 or an inward direction 57 as shown in FIGS. 2 and 3.

The left and right end caps 18, 20 and outer case 16 comprise a muffler housing. Left end cap 18 is lockseamed to left side 34 of outer case 16, as shown in FIG. 1, and has an inner surface 88 and an outer surface 90, as shown in FIGS. 1 and 8–15. Inner surface 88 of left end cap 18 faces toward right end cap 20, and outer surface 90 of left end cap 18 faces away from right end cap 20. Left end cap 18 also includes a flat cap portion 86 and a folded lockseam portion 87 surrounding cap portion 86. Cap portion 86 simply closes off the left side 34 of outer case 16 as shown in FIG. 1. Lockseam portion 87 includes a lockseam joint (or bend) 89 between the left end cap 18 and the inner plate 30 so that a channel 84 is defined within the lockseam portion 87 for receiving the outer plate 32 as shown in FIGS. 8–15.

Right end cap 20 is similar to left end cap 18 and is lockseamed to a right side 36 of outer case 16 in a similar manner as left end cap 18 is lockseamed to outer case 16. Right end cap 20, as shown in FIGS. 16–23, has an inner surface 96 and an outer surface 98. Inner surface 96 faces towards left end cap 18 and outer surface 98 faces away from left end cap 18. Right end cap 20 also includes a flat cap portion 94 and a folded lockseam portion 95 surrounding cap portion 94. Lockseam portion 95 includes a lockseam joint (or bend) 97 between the right end cap 20 and the inner plate 30 so that a channel 85 is defined within the lockseam portion 95 for receiving the outer plate 32 as shown in FIGS. 8–15.

Inlet tube 22, interior tube 24, and outlet tube 26, shown in FIGS. 1 and 3, permit exhaust fumes or gas to pass through muffler 10. As shown in FIG. 1, inlet tube 22 extends through; a hole or aperture 91 formed in cap portion 86 of left end cap 18 to allow exhaust fumes (not shown) to enter muffler 10. Within muffler 10, as shown in FIG. 3, exhaust fumes pass from inlet tube 22 to outlet tube 26 via interior tube 24. Interior tube 24 extends through the center 59 of outer case 16 and simply transfers exhaust fumes from inlet tube 22 to outlet tube 26. Outlet tube 26 extends through a hole (not shown) formed in right end cap 20, as shown in FIG. 1, to allow the exhaust fumes to exit muffler 10.

Baffle plate 28, shown in FIG. 3, is a flat, oval-shaped piece of material that is coupled to inner plate 30. Baffle plate 28 is positioned to lie approximately half way between the left and right end caps 18, 20 within multiple-plated outer case 16. Baffle plate 28 helps support exhaust tubes 22, 24, 26 in the proper position relative to outer case 16. In alternative embodiments, any number or types of tubes, baffles, stamp-formed plates, or other exhaust-gas-directing mechanisms may be used with the present invention.

Multiple-plated outer case 16 of muffler 10 includes an inner plate 30 and an outer plate 32 and has a left side 34, a right side 36, a top side 38, a bottom side 40, a front side 46, and a back side 48, as shown in FIG. 1. Inner plate 30 is positioned to lie inside and adjacent to outer plate 32, as shown in FIGS. 1 and 3. As shown in FIG. 3, inner and outer plates 30, 32 of multiple-plated outer case 16 extend circumferentially around oval-shaped baffle plate 28 and are lockseamed together along top side 38 of multiple-plated outer case 16.

Inner and outer plates 30, 32 each have an inner surface 42, 52 and an outer surface 44, 54, respectively, as shown in FIG. 3. Inner surface 42 of inner plate 30 abuts a perimeter surface 60 of oval-shaped baffle plate 28 and inner surface 52 of outer plate 32 abuts outer surface 44 of inner plate 30 so that outer plate 32 is in a close-fitting connection with inner plate 30. The close-fitting connection between outer plate 32 and inner plate 30, however, does allow for air (not shown) to thermally insulate inner plate 30 from outer plate 32 to provide resistance to thermal conductivity, as described below. Thus, inner plate 30, outer plate 32, and baffle plate 28 substantially abut one another so that outer case 16 is substantially oval-shaped as shown in FIG. 3. Inner plate 30, outer plate 32, and baffle plate 28 may be made out of the same material (e.g., 409 stainless steel) or different types of material.

As shown in FIGS. 1–3, outer plate 32 is formed to include a notch member 64 that extends along bottom side 40 of outer case 16. Notch member 64 defines circumferential expansion portion 12 that allows outer plate 32 to flex circumferentially outwardly relative to inner plate 30 in direction 56 or inwardly relative to inner plate 30 in direction 57 (shown in FIG. 3) to accommodate any thermal expansion or contraction that occurs due to temperature differences between inner plate 30 and outer plate 32. As shown best in FIGS. 1 and 3, notch member 64 includes a front wall 66, a back wall 67, a bottom wall 68, a left wall 69, and a right wall 70. As shown in FIGS. 3–7, front and back walls 66, 67 have approximately the same dimensions and are configured to project outwardly away from inner plate 30 so that bottom wall 68 is spaced apart from of inner plate 30.

Figure 4:
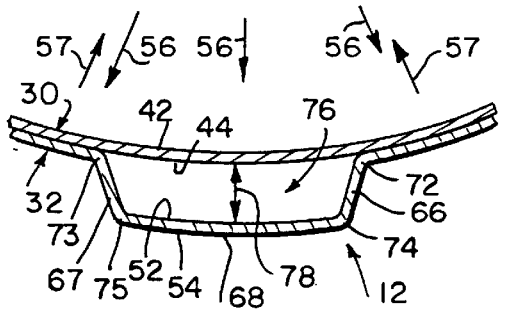
FIGS. 4–7 are sectional views taken along line 4—4 of FIG. 2 showing how the notch member defining the circumferential expansion portion adjusts to compensate for the expansion of the inner plate circumferentially outwardly relative to the outer plate as the inner plate heats up relative to the outer plate under various conditions.

A plurality of joints 72, 73, 74, 75 interconnects walls 66, 67, 68 of notch member 64 as shown in FIG. 4. Outwardly projecting front and back walls 66, 67 originate at first and second joints 72, 73 respectively, and terminate at third and fourth joints 74, 75, respectively. Front and back walls 66, 67 project slightly towards one another so that first and second joints 72, 73 are spaced farther apart from one another than are third and fourth joints 74, 75. Bottom wall 68 extends between left and right side walls 66, 67 at third and fourth joints 74, 75, respectively, and is substantially parallel to inner plate 30. A gap 76 having a depth 78 is formed between inner plate 30 and bottom wall 68 of outer plate 32 as a result of notch member 64 being formed in outer plate 32. Thus, circumferential expansion portion 12 is defined by notch member 64 interacting with inner plate 30 to form a trapezoid-shaped gap 76 extending longitudinally parallel to longitudinal axis 58 between left and right end caps 18, 20 as shown in FIGS. 1 and 4.

Outer plate 32 further includes first and second channel-engaging portions 80, 82 which are coupled to inner plate 30 and end caps 18, 20, as shown in FIGS. 8–23. As shown in FIGS. 8–23, the inner plate 30 and outer plate 32 are substantially sealed from moisture and contaminants. The left wall 69 and right wall 70 of notch member 64 shown in FIG. 1, interconnect the front, back, and bottom walls 66, 67, 68 of notch member 64 to first and second channel-engaging portions 80, 82. As shown in FIGS. 8–11, left wall 69 extends from a fifth joint 81 at bottom wall 68 to a sixth joint 83 at first channel-engaging portion 80. First channel-engaging portion 80 abuts inner plate 30 and left end cap 18, as shown in FIGS. 8–15. The operation of first channel-engaging portion 80 will be described in more detail below. As shown in FIGS. 16–19, the right wall 70 of notch member 64 extends from a seventh joint 77 at bottom wall 68 to an eighth joint 79 at second channel-engaging portion 82 of outer plate 32. Similar to first channel-engaging portion 80, second channel-engaging portion 82 abuts inner plate 30 and right end cap 20.

Circumferential expansion portion 12 allows inner plate 30 and outer plate 32 to move relative to one another in response to thermal expansion or contraction. As shown in FIGS. 4–11 and 16–19, circumferential expansion portion 12 moves from a steady-state condition (FIGS. 4, 8, 16) when inner and outer plates 30, 32 are at ambient temperature towards a maximum-adjusting condition (FIGS. 7, 11, 19) when inner plate 30 is hotter than outer plate 32. As can be seen from FIGS. 4–11 and 16–19, circumferential expansion portion 12 acts as a spring to compensate for circumferential thermal expansion or contraction of inner plate 30 relative to outer plate 32. The transitions of circumferential expansion portion 12 are described below as they would occur under normal operating conditions. The examples used below are only representative of the conditions that may cause thermal expansion or contraction and do not limit the scope of the invention.

In operation, circumferential expansion portion 12 allows outer plate 32 to flex circumferentially outwardly in direction 56 when inner plate 30 heats up faster than outer plate 32 or when outer plate 32 cools down more quickly than inner plate 30. For example, when inner plate 30 heats up faster than outer plate 32, inner plate 30 expands outwardly relative to outer plate 32 in direction 56 and circumferential expansion portion 12 accommodates this expansion of inner plate 30 relative to outer plate 32 by allowing outer plate 32 to flex circumferentially outwardly in direction 56. Similarly, when outer plate 32 cools down more quickly than inner plate 30, outer plate 32 contracts relative to inner plate 30 in direction 57 and circumferential expansion portion 12 accommodates this contraction of outer plate 32 relative to inner plate 30 by allowing outer plate 32 to flex circumferentially outwardly in direction 56. An example will now be used to illustrate this relative expansion and contraction of inner and outer plates 30, 32.

Before an engine that is coupled to muffler 10 is started, inner and outer plates 30, 32 of muffler 10 are at the ambient temperature. Because inner and outer plates 30, 32 are at the same temperature, inner plate 30 is not expanding or contracting relative to outer plate 32 and outer plate 32 is not expanding or contracting relative to inner plate 30. Therefore, inner plate 30 is not pushing outwardly on outer plate 32 due to thermal expansion and outer plate 32 is not pushing inwardly on inner plate 30 due to thermal contraction. In this condition, shown in FIGS. 3 and 4, side walls 66, 67 of circumferential expansion portion 12 extend away from inner plate 30 so that third and fourth joints 74, 75 are just slightly closer to one another than are first and second joints 72, 73. Thus, when circumferential expansion portion 12 is in a steady-state condition, gap 76 has relatively large depth 78, and notch member 64 is trapezoid-shaped.

Figure 5:
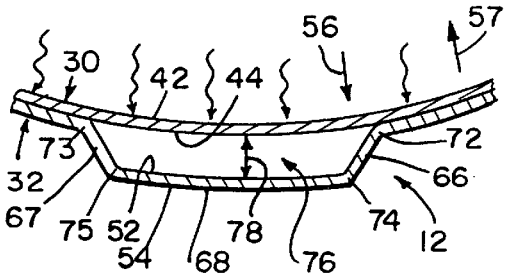

When the engine is initially started and heated exhaust fumes begin to flow through muffler 10, a moderate amount of heat 210 is applied to inner plate 30, as shown in FIG. 5. Because the heated exhaust fumes are in direct contact with inner plate 30 and because inner plate 30 is insulated from outer plate 32 by air (not shown), inner plate 16 heats up faster than outer plate 18. Thus, when the engine is initially started, inner plate 30 is at a slightly higher temperature than outer plate 32 and inner plate 30 expands outwardly relative to outer plate 32 in direction 56 (because inner and outer plates 30, 32 are preferably made from the same material). This causes inner plate 30 to push circumferentially outwardly relative to outer plate 32 in direction 56 against outer plate 32.

Circumferential expansion portion 12 accommodates this circumferential thermal expansion of inner plate 30 by allowing outer plate 32 to flex circumferentially outwardly in direction 56 in response to inner plate 30 pushing outwardly in direction 56 on outer plate 32. As inner plate 30 initially begins to push outwardly on outer plate 32, circumferential expansion portion 12 begins to flatten relative to inner plate 30 and circumferential expansion portion 12 assumes an initial-warm-up condition which is shown in FIG. 5. As shown in FIG. 5, circumferential expansion portion 12 begins to flatten relative to inner plate 30 because first and second joints 72, 73 move away from one another and side walls 66, 67 become flatter relative to inner plate 30 as inner plate 30 pushes against outer plate 32 in direction 56. This causes bottom wall 68 to move slightly closer to inner plate 30 which results in the depth 78 of gap 76 decreasing. Because inner plate 30 is pushing outwardly on outer plate 32 due to thermal expansion, side walls 66, 67 of expansion portion 12 are pushed apart and become flatter relative to inner plate 30 so that bottom wall 68 is pulled closer to inner plate 30. This allows outer plate 32 to act as a spring to compensate for the thermal expansion.

Figure 6:
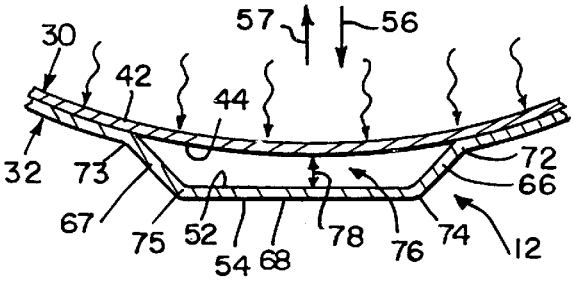

As the engine continues to warm up, an intense amount of heat 212 is applied to inner plate 30, as shown in FIG. 6, and circumferential expansion portion 12 continues to flatten until it reaches a maximum-warm-up condition which is shown in FIG. 6. As circumferential expansion portion 12 transitions from the position shown in FIG. 5 to the position shown in FIG. 6, inner plate 30 continues to expand outwardly relative to outer plate 32 because the temperature difference between inner plate 30 and outer plate 32 continues to increase. Inner and outer plates 30, 32 are both expanding outwardly because both are increasing in temperature, however, inner plate 30 is expanding at a faster rate than outer plate 32 and therefore inner plate 30 is expanding outwardly relative to outer plate 32. Thus, because inner plate 30 is expanding outwardly relative to outer plate 32 as the engine initially warms up, circumferential expansion portion 12 continues to move closer to the maximum-warm-up condition of FIG. 6.

When circumferential expansion portion 12 reaches the maximum-warm-up condition (shown in FIG. 6), inner plate 3 0 is increasing in temperature at the same rate as outer plate 32. At this point, inner plate 30, although still getting hotter, is beginning to slow down in temperature rate increase. In other words, inner plate 30 and outer plate 32 are still expanding outwardly, but both are expanding outwardly at the same rate. Therefore, at this point, as shown in FIG. 6, circumferential expansion portion 12 is at a maximum-warm-up condition where the temperature difference between inner plate 30 and outer plate 32 is at a maximum for the warm-up process.

From this point, under normal operating conditions (i.e., where the engine and muffler 10 are warmed up in a controlled environment and cold water is not splashed on outer plate 32), outer plate 32 begins to increase in temperature at a faster rate than inner plate 30 because the exhaust fumes have warmed inner plate 30 up to (or close to) the temperature of the exhaust fumes. The rate at which inner plate 30 is increasing in temperature begins to slow down, while the rate at which outer plate 32 is increasing in temperature continues to increase. In addition, the rate of temperature increase of the inner plate 30 begins to decrease relative to the rate of temperature increase of the outer plate 32. As a result, the temperature difference between inner plate 30 and outer plate 32 begins to decrease and outer plate 32 begins to expand outwardly relative to inner plate 30.

This reduction in temperature difference between inner and outer plates 30, 32 causes circumferential expansion portion 12 to begin to transition back towards the initial-warm-up condition of FIG. 5. Circumferential expansion portion 12 will continue to transition from the maximum-warm-up condition (shown in FIG. 6) towards the initial-warm-up condition (shown in FIG. 5) as the engine continues to warm up because the outer plate 32 is expanding outwardly relative to inner plate 30 and, as a result, inner plate 30 no longer pushes outwardly against outer plate 32. However, circumferential expansion portion 12 will not transition all the way back to the steady-state condition of FIG. 4 even when the engine is completely warmed up because inner plate 30 remains at a higher temperature than outer plate 32 because of the resistance to thermal conductivity between inner plate 30 and outer plate 32. Thus, when the engine is completely warmed up, circumferential expansion portion 12 is at a steady-state warmed-up condition which can be any position between FIGS. 4 and 6, but most likely between FIGS. 5 and 6.

Figure 7:
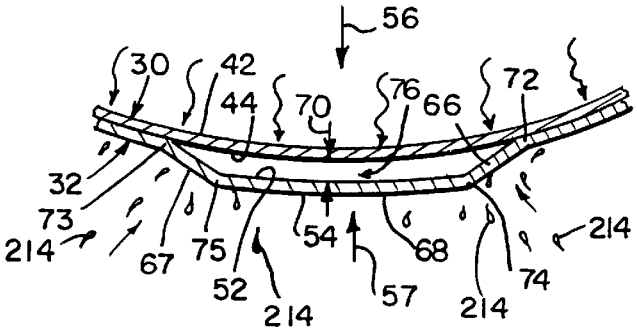

Circumferential expansion portion 12 will remain in this steady-state warmed-up condition (somewhere between FIGS. 4 and 6) as long as the temperature difference between inner and outer plates 30, 32 remains constant. However, under normal operating conditions, the muffler 10 could be splashed by cold water 214 which would hit outer plate 32. This would cause circumferential expansion portion 12 to become even flatter as shown by the maximum-adjusting condition of FIG. 7. When muffler 10 is splashed by cold water 214, outer plate 32 is cooled down relative to inner plate 30 and thus outer plate 32 contracts relative to inner plate 30 so that outer plate 32 begins pushing inwardly in direction 57 against inner plate 30. Circumferential expansion portion 12 accommodates this thermal contraction of outer plate 32 relative to inner plate 30 by transitioning from the position shown in FIG. 6 towards the position shown in FIG. 7. Specifically, when outer plate 32 becomes colder than inner plate 30, outer plate 32 pushes inwardly on inner plate 30 in direction 57 and expansion portion 12 becomes flatter relative to inner plate 30 to compensate for the thermal contraction of outer plate 32 relative to inner plate 30. Circumferential expansion portion 12 becomes flatter because first and second joints 72, 73 move away from one another, side walls 66, 67 become flatter relative to inner plate 30, bottom wall 68 moves closer to inner plate 30, and the depth 78 of gap 76 decreases as shown in FIG. 7.

FIGS. 8–11 and 16–19 provide a different sectional view, respectively, of circumferential expansion portion 12 than FIGS. 4–7 which were just described. In addition to showing circumferential expansion portion 12, FIGS. 8–23 also illustrate longitudinal expansion portions 14, 15.

As in circumferential expansion portion 12, longitudinal expansion portions 14, 15 also accommodate relative thermal expansion and contraction of inner and outer plates 30, 32 of outer case 16. While circumferential expansion portion 12 accommodates circumferential thermal expansion or contraction in directions 56, 57, as shown in FIG. 3, longitudinal expansion portions 14, 15 accommodate longitudinal thermal expansion or contraction in directions 61, 62, as shown in FIG. 1.

As shown in FIGS. 8–15, longitudinal expansion portion 14 is the portion of muffler 10 where left end cap 18 is lockseamed with left side 34 of outer case 16. The lockseam between left end cap 18 and outer case 16 extends around the circumference of outer case 16 as shown in FIG. 1. FIGS. 8–11, which are sectional views taken along line 8—8 of FIG. 1, show a portion of longitudinal expansion portion 14 where circumferential expansion portion 12 can also be seen. FIGS. 20–23, which are taken along line 20—20 of FIG. 1, show that longitudinal expansion portion 14 also extends around the entire circumference of outer case 16, even where circumferential expansion portion 12 is not present (i.e., along the front side 46, top side 38, and back side 48).

Left end cap 18 is lockseamed with outer case 16 to define a channel 84 within the lockseam between outer surface 44 of inner plate 30 and outer surface 90 of left end cap 18. Channel 84 extends around the circumference of the left side 34 of outer case 16 and is sized to allow first channel-engaging portion 80 of outer plate 32 to be in sliding engagement with inner plate 30 of left end cap 18. Channel 84 only permits outer plate 32 to slide longitudinally in directions 61, 62 and is of sufficient length so that outer plate 32 will not slide out of channel 84 when thermal expansion or contraction occurs as described below.

The operation of longitudinal expansion portion 14 will now be explained with reference to the same operating conditions as were previously described for circumferential expansion portion 12. As shown in FIGS. 8–15, longitudinal expansion portion 14 transitions from a steady-state condition (shown in FIGS. 8 and 12) towards a maximum-adjusting condition (shown in FIGS. 11 and 15) to accommodate longitudinal thermal expansion or contraction of inner plate 30 relative to outer plate 32 in directions 61, 62 (shown in FIG. 1) when the following conditions occur.

Figure 8:
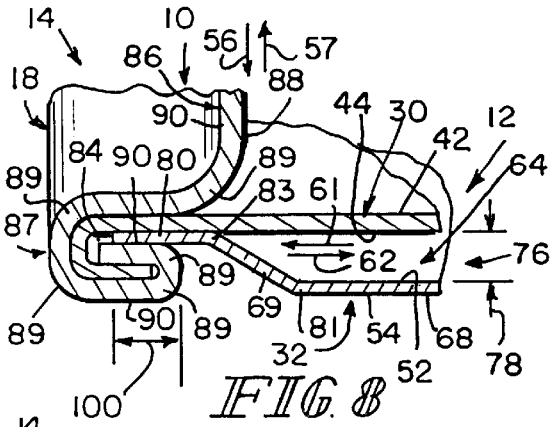
FIGS. 8–11 and 12–15 are sectional views taken along lines 8—8 and 12—12, respectively, of FIG. 1 showing a different portion of the circumferential expansion portion and a first circumferentially extending longitudinal expansion portion adjusting to compensate for relative expansion and contraction of the inner and outer plates.
Figure 12:
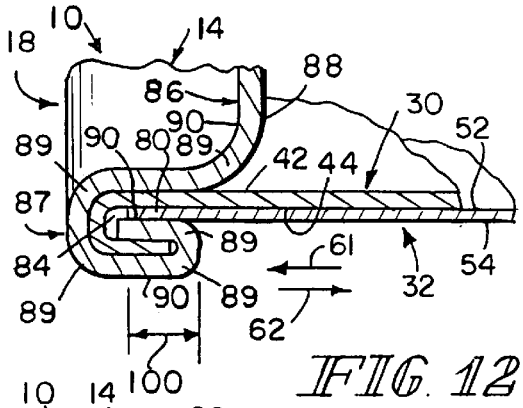

Before the engine is started, inner and outer plates 30, 32 are at an ambient temperature and longitudinal expansion portion 14 is in a steady-state condition which is shown in FIGS. 8 and 12. In this condition, first channel-engaging portion 80 of outer plate 32 extends almost entirely into channel 84 a distance 100 so that a major portion of outer surface 54 of first channel-engaging portion 80 engages outer surface 90 of left end cap 18.

Figure 9:
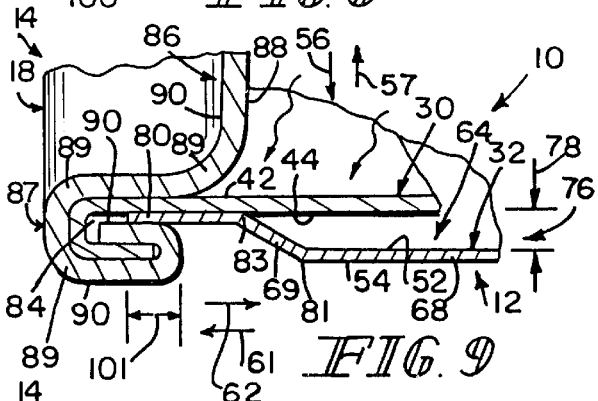
Figure 13:
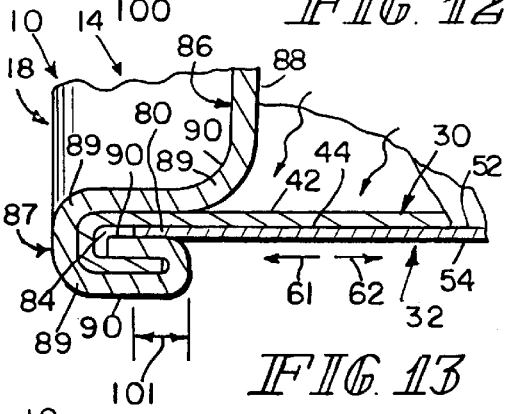

When the engine is started and heated exhaust fumes begin to flow through muffler 10, longitudinal expansion portion 14 begins to transition from the steady-state condition shown in FIGS. 8 and 12 towards an initial-warm-up condition shown in FIGS. 9 and 13. As shown in FIGS. 9 and 13, when the engine is started, a moderate amount of heat 210 is applied to inner plate 30 and left end cap 18 which makes inner plate 30 and left end cap 18 just slightly hotter than outer plate 32. This temperature difference causes inner plate 30 and left end cap 18 to expand longitudinally outwardly relative to outer plate 32 in direction 61. As a result, outer plate 32 slides longitudinally inwardly within channel 84 away from left end cap 18 in direction 62. Longitudinal expansion portion 14 accommodates this expansion of inner plate 30 and left end cap 18 relative to outer plate 32 by allowing inner plate 30 and left end cap 18 to move longitudinally outwardly in direction 61 away from outer plate 32. Thus, as the engine initially heats up, first channel-engaging portion 80 of outer plate 32 slides within channel 84 away from left end cap 18 in direction 62 until a smaller portion of first channel-engaging portion 80 engages outer surface 90 of left end cap 18, as shown in FIGS. 9 and 13. In FIGS. 9 and 13, first channel-engaging portion 80 extends into channel 84 a distance 101 which is smaller than distance 100 in FIGS. 8 and 12.

Figure 10:
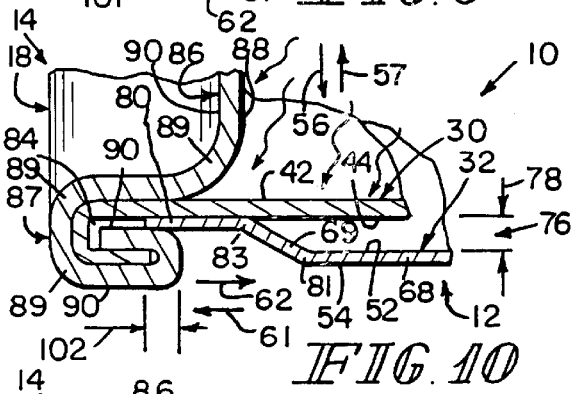
Figure 14:
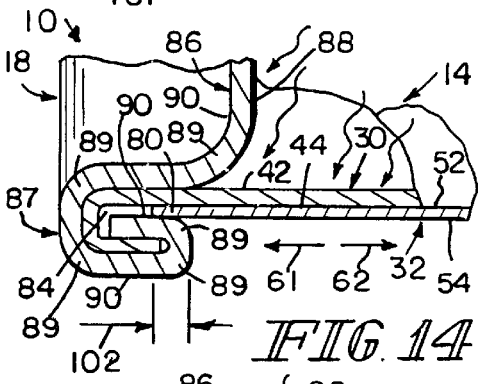

As the engine continues to warm up, inner plate 30 and left end cap 18 continue to increase in temperature more quickly than outer plate 32 and an intense amount of heat 212 is applied to inner plate 30 and left end cap 18, as shown in FIGS. 10 and 14. Thus, inner plate 30 and left end cap 18 continue to expand longitudinally outwardly relative to outer plate 32 in direction 61. Inner and outer plates 30, 32 and left end cap 18 are each expanding longitudinally outwardly because each are increasing in temperature. However, inner plate 30 and left end cap 18 are expanding faster than outer plate 32 (because inner plate 30 and left end cap 18 are in direct contact with the exhaust fumes) and therefore inner plate 30 and left end cap 18 are expanding longitudinally outwardly relative to outer plate 32 in direction 61. As a result, as the engine continues to warm up, channel-engaging portion 80 continues to slide out of channel 84 until longitudinal expansion portion 14 reaches a maximum-warm-up condition which is shown in FIGS. 10 and 14.

When longitudinal expansion portion 14 reaches the maximum warm-up condition (FIGS. 10 and 14), inner plate 30; outer plate 32, and left end cap 18 are all increasing in temperature at the same rate and therefore expanding at the same rate. At this point, the temperature difference between inner plate 30 and outer plate 32 is at a maximum for the warm-up process. In this condition, shown in FIGS. 10 and 14, channel-engaging portion 80 extends a distance 102 into channel 84 which, in the illustrated embodiment, is approximately one-fourth of the way into channel 84.

From this point in the warm-up process, under normal operating conditions, outer plate 32 begins to increase in temperature at a faster rate than inner plate 30 and left end cap 18. Inner plate 30, outer plate 32, and left end cap 18 are still each increasing in temperature, but now outer plate 32 begins to increase in temperature at a faster rate than inner plate 30 and left end cap 18. As a result, outer plate 32 starts expanding.outwardly relative to inner plate 32 and left end cap 18 and therefore outer plate 32 begins to slide back into channel 84 towards left end cap 18. Thus, longitudinal expansion portion 14 begins to move back towards the initial-warm-up condition shown in FIGS. 9 and 13.

Longitudinal expansion portion 14 continues to transition from the maximum-warm-up condition (FIGS. 10 and 14) towards the initial warm-up condition (FIGS. 9 and 13) as the engine continues to warm up past the maximum-warm-up condition. However, longitudinal expansion portion 14 will not transition all the way back to the steady-state condition (FIGS. 8 and 12) even when the engine is completely warmed up because inner plate 30 remains at a higher temperature than outer plate 32 due to the resistance to thermal conductivity between inner plate 30 and outer plate 32. Thus, when the engine is completely warmed up, longitudinal expansion portion 15 is at a steady-state-warmed-up condition which can be any position between FIGS. 8, 12 and 10, 14, but most likely between FIGS. 9, 13 and 10, 14.

Figure 11:
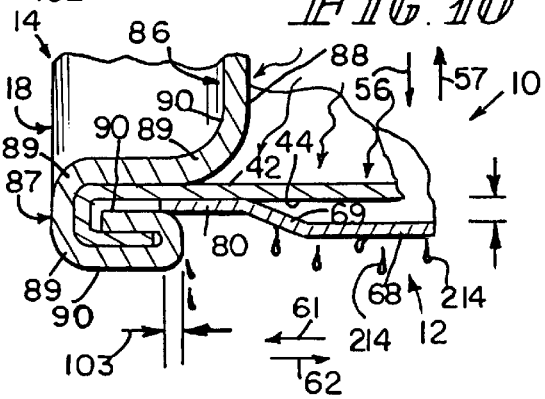
Figure 15:
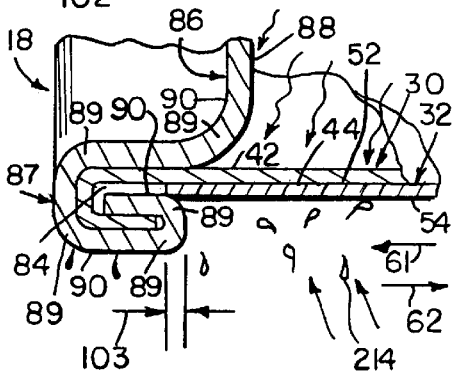
Figure 16:
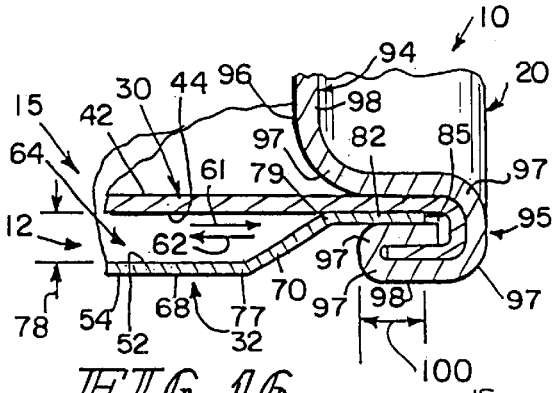
FIGS. 16–19 and 20–23 are sectional views taken along lines 16—16 and 20—20, respectively, of FIG. 1 showing a second circumferentially extending longitudinal expansion portion under the same conditions shown in FIGS. 8–15 for the first circumferentially extending longitudinal expansion portion.
Figure 20:
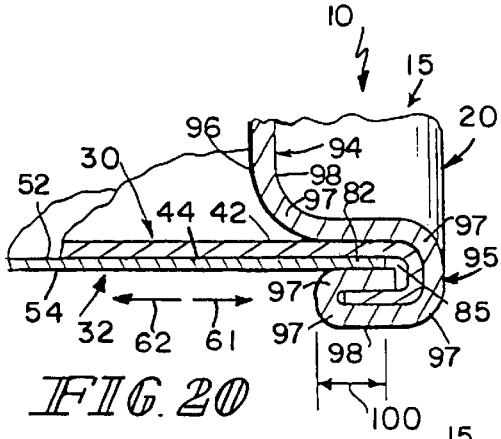
Figure 17:
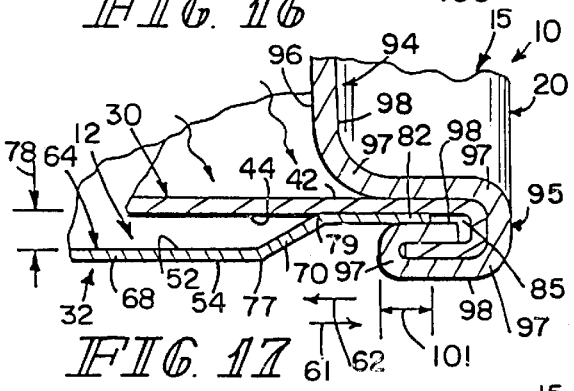
Figure 21:
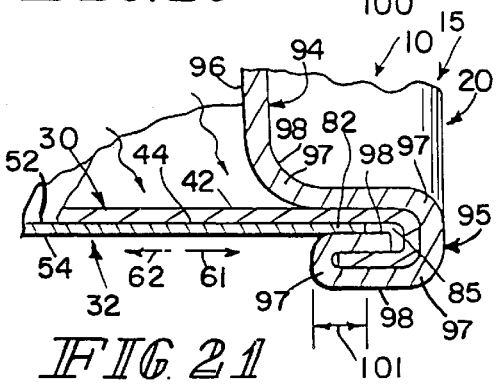
Figure 18:
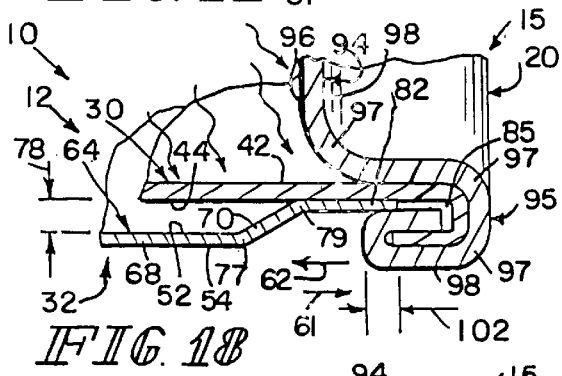
Figure 22:
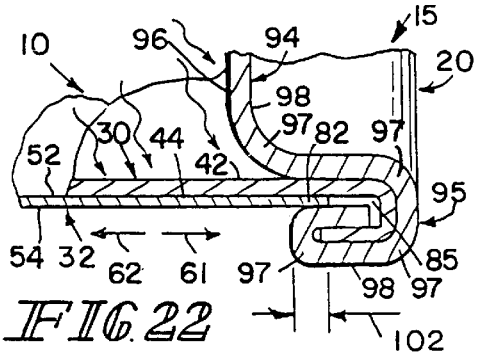
Figure 19:
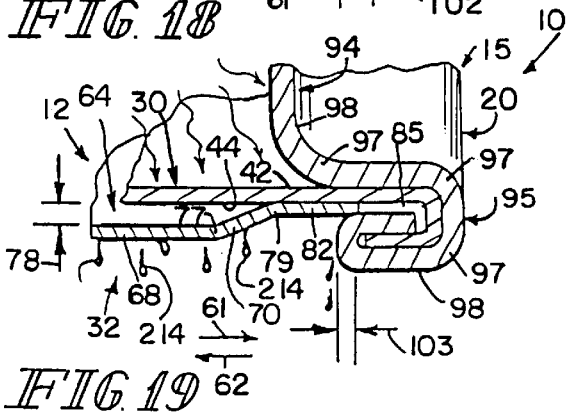
Figure 23:
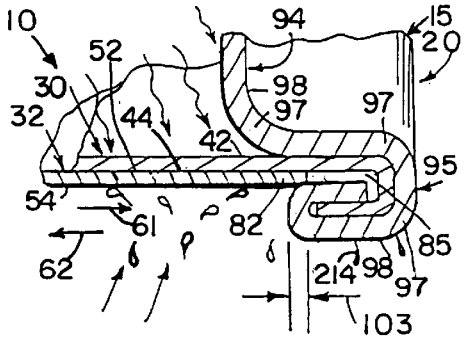

Longitudinal expansion portion 14 will remain in this steady-state-warmed-up condition as long as the temperature difference between inner and outer plates 30, 32 remains constant. However, if muffler 10 is splashed by a cold puddle causing cold water 214 to hit outer plate 32 when an intense amount of heat 212 is being applied to inner plate 30 and left end cap 18 as shown in FIGS. 11, 15, longitudinal expansion portion 14 begins to transition from this steady-state-warmed-up condition (between FIGS. 8, 12 and 10, 14) towards the maximum-adjusting condition, (FIGS. 11 and 15). Because outer plate 32 is cooled down relative to inner plate 30 when a puddle is hit, outer plate 32 contracts relative to inner plate 30 and, as a result, first channel-engaging portion 80 begins to slide out of channel 84 away from left end cap 18 in direction 62. As a result, longitudinal expansion portion 14 begins to move towards a maximum-adjusting condition shown in FIGS. 11 and 15.

Although hitting an extremely cold puddle could cause longitudinal expansion portion 14 to reach the maximum-adjusting condition of FIGS. 11, 15, longitudinal expansion portion 14 could be designed in such a way that the maximum adjusting position of FIGS. 11, 15 is never reached. For example, longitudinal expansion portion 14 could be designed to require sub-freezing temperatures so that even under the extreme example just described, the positions of inner and outer plates 16, 18 shown in FIGS. 11, 15 would still not be reached. Nevertheless, FIGS. 11, 15 represent a "worst case" condition where there is extreme heating of inner plate 30 and left end cap 18 and extreme cooling of outer plate 32. This could occur, for example, when muffler 10 hits a cold puddle at the exact moment in the warm-up process where longitudinal expansion portion 14 is at its maximum-warm-up condition (i.e., FIGS. 10, 14). Thus, from the maximum-warm-up condition of FIGS. 10, 14, a cold puddle could cause outer plate 32 to contract relative to inner plate 30 so that the maximum adjusting condition of FIGS. 11, 15 is reached (or nearly reached). Therefore, it is not beyond the scope of this invention for different events (other than starting a cold engine and/or hitting a puddle) to define the various conditions or states of longitudinal expansion portion 14 (shown in FIGS. 8–15) so that longitudinal expansion portion 14 would be capable of accommodating many causes of thermal expansion or contraction of inner and outer plates 30, 32.

Nevertheless, once outer plate 32 reaches its maximum coldness from having been splashed by a cold puddle after being completely warmed up, outer plate 32 begins to warm back up because of the high temperature of inner plate 30. Thus, although longitudinal expansion portion 14 may not reach the maximum-adjusting condition shown in FIGS. 11, 15, it does reach a maximum-puddle-adjusting condition which can be any position between FIGS. 8, 12 and 11, 15. From this maximum-puddle-adjusting condition, longitudinal expansion portion 14 begins to transition back to the steady-state-warmed-up condition of FIGS. 10, 14. This process is similar to the process described above when longitudinal expansion portion 14 transitioned from the maximum-warm-up condition of FIGS. 10, 14 to the steady-state-warmed-up condition (between FIGS. 8. 12 and 10, 14).

Second longitudinal expansion portion 15 is shown in FIGS. 16–23. Second longitudinal expansion portion 15 is identical to first longitudinal expansion portion 14 except that second longitudinal expansion portion 15 is the portion of muffler 10 where right end cap 20 is lockseamed with inner plate 30 of outer case 16. Thus, as shown in FIGS. 16–23, second longitudinal expansion portion 15 includes a lockseam between right end cap 20 and right side 36 of outer case 16 defining a channel 85 between outer surface 44 of inner plate 30 and outer surface 94 of right end cap 20 that extends around the circumference of the right side 36 of outer case 16. The channel 85 receives second channel-engaging portion 82 of outer plate 32 to allow outer plate 32 to slide longitudinally relative to inner plate 30 in directions 61, 62 in response to thermal heating or cooling. The description of the operation of longitudinal expansion portion 14 with reference to FIGS. 8–15 is identical to the operation of longitudinal expansion portion 15 shown in FIGS. 16–23, respectively, aside from the difference's just described.

Figure 24:
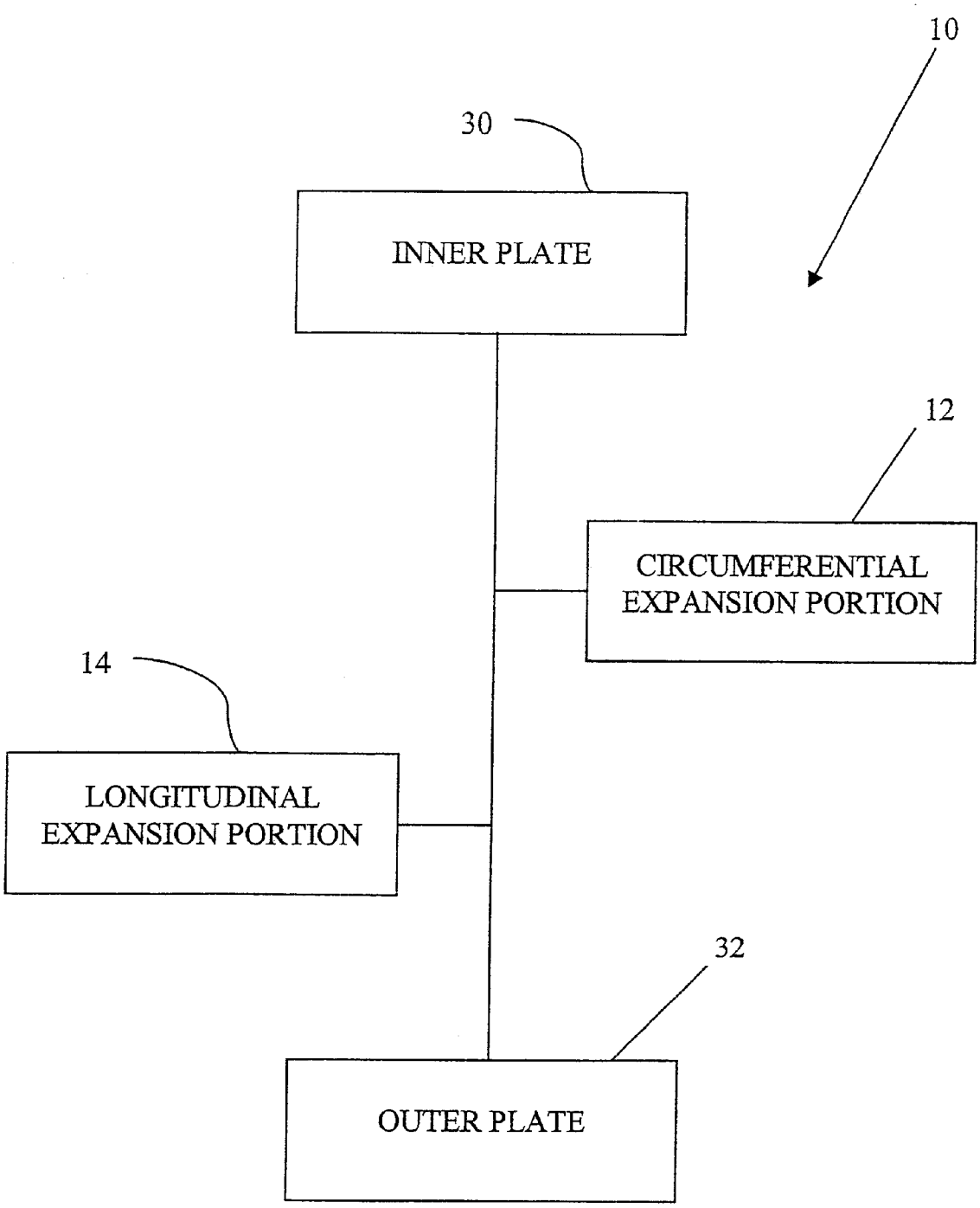
FIG. 24 is a block diagram of an exhaust component in accordance with the present invention, the exhaust component including an inner plate, an outer plate, a longitudinal expansion portion, and a circumferential expansion portion.

The muffler or exhaust component 10 is shown in block diagram form in FIG. 24. Muffler 10 includes inner plate 30, outer plate 32, a circumferential expansion portion 12, and a longitudinal expansion portion 14. Circumferential expansion portion 12 permits inner and outer plates 30, 32 to move circumferentially relative to one another and longitudinal expansion portion 14 permits inner and outer plates 30, 32 to move longitudinally relative to one another.

Although this invention has been described in detail, variations and modifications exist within the scope and spirit of the invention as described and as defined in the following claims.

What is claimed is:

1. An exhaust component having a longitudinal axis, the exhaust component comprising a first end cap, a second end cap spaced apart from the first end cap, an inner shell coupled to the first and second end caps, a channel being defined between the inner shell and one of the first and second end caps, and an outer shell coupled to the first and second end caps, a portion of the outer shell being positioned in the channel defined between the inner shell and one of the first and second end caps to move longitudinally through the channel relative to the inner shell, and the outer shell including a notch member that is spaced apart from the inner shell, the notch member being configured to change shape to permit the outer shell to move circumferentially relative to the inner shell.

2. The exhaust component of claim 1, wherein the notch member is spaced apart from the inner plate by a distance and the distance between the notch member and inner plate changes as the inner and outer plates move circumferentially relative to each other.

3. The exhaust component of claim 1, wherein the notch member extends longitudinally substantially parallel to the longitudinal axis of the exhaust component.

4. The exhaust component of claim 1, wherein the inner shell and outer shell are coupled to substantially seal a volume defined between the inner and outer shells.

5. The exhaust component of claim 1, wherein the outer shell and inner shell are coupled together in a lockseam.

6. The exhaust component of claim 1, wherein the inner shell is coupled to the first end cap in a lockseam and to the second end cap in a lockseam.

7. The exhaust component of claim 1, wherein a second channel is defined between the inner shell and the other of the first and second end caps and the outer shell is positioned in the second channel to move longitudinally through the second channel relative to the inner shell.

8. An exhaust component having a longitudinal axis, the exhaust component comprising an inlet configured to receive exhaust gas, an outlet configured to discharge exhaust gas, a housing, the housing including inner and outer plates that are movable relative to each other in a longitudinal direction that is substantially parallel to the longitudinal axis, and an expanding joint located in one of the inner and outer plates to permit the inner and outer plates to move in a circumferential direction.

9. The exhaust component of claim 8, wherein the housing further includes first and second end caps and the first and second end caps are coupled to the inner and outer plates.

10. The exhaust component of claim 9, wherein the first end cap and inner plate define a first channel, the second end cap and inner plate define a second channel, and the outer plate is positioned to move through the first and second channels as the inner and outer plates move longitudinally relative to each other.

11. The exhaust component of claim 9, wherein at least one of the end caps and the inner plate define a channel and the outer plate is positioned to move through the channel as the inner and outer plates move longitudinally relative to each other.

12. The exhaust component of claim 9, wherein at least one of the end caps defines a channel and one of the inner and outer plates are positioned to move through the channel as the inner and outer plates move longitudinally relative to each other.

13. The exhaust component of claim 9, wherein the first and second end caps define first and second channels, respectively, and one of the inner and outer plates are positioned to move through the first and second channels as the inner and outer plates move longitudinally relative to each other.

14. The exhaust component of claim 9, wherein the inner plate is coupled to the first end cap in a lockseam and to the second end cap in a lockseam.

15. The exhaust component of claim 8, wherein the expanding joint is placed in the outer plate and includes a notch member that is spaced apart from the inner plate by a distance.

16. The exhaust component of claim 15, wherein the distance between the notch member and inner plate changes as the inner and outer plates move relative to each other.

17. The exhaust component of claim 15, wherein the notch member extends substantially parallel to the longitudinal axis of the exhaust component.

18. The exhaust component of claim 8, wherein the inner plate and outer plate are coupled to substantially seal a volume defined between the inner and outer plates.

19. The exhaust component of claim 8, wherein the outer plate and inner plate are coupled together in a lockseam.

20. A housing for an exhaust component having a longitudinal axis, the housing comprising an outer shell, an inner shell positioned within the outer shell, an expanding joint located within the outer shell for permitting relative longitudinal movement of the inner and outer shells in response to temperature differences between the inner and outer shells, and means for permitting relative circumferential movement of the inner and outer shells in response to temperature differences between the inner and outer shells.

21. The housing of claim 20, wherein the outer shell and inner shell are coupled together in a lockseam.

22. A housing for an exhaust component having a longitudinal axis, the housing comprising an outer shell, an inner shell positioned within the outer shell, and an expanding joint located within the outer shell for permitting relative circumferential movement of the inner and outer shells in response to temperature differences between the inner and outer shell.

* * * * *